United States Patent [19]

Harnish

[11] 4,221,116

[45] Sep. 9, 1980

[54] TEMPERATURE COMPENSATED CONTROL FOR AIR CONDITIONING SYSTEM OR HEAT PUMP

[75] Inventor: James R. Harnish, York, Pa.

[73] Assignee: Borg-Warner Corporation, Chicago, Ill.

[21] Appl. No.: 912,636

[22] Filed: Jun. 5, 1978

[51] Int. Cl.[2] ..... F25B 41/00; F25B 1/00

[52] U.S. Cl. ..... 62/209; 62/227; 62/228

[58] Field of Search ..... 62/209, 211, 226, 227, 62/228 D, 196 A; 417/19, 32

[56] References Cited

U.S. PATENT DOCUMENTS

| | | | |
|---|---|---|---|
| 2,191,966 | 2/1940 | Spangenberg | 62/208 |
| 2,215,057 | 9/1940 | Shaw | 62/209 |
| 2,218,944 | 10/1940 | Wolfert | 62/4 |
| 2,226,297 | 12/1940 | Spangenberg | 62/208 |
| 3,113,439 | 12/1963 | Eargle | 62/160 |
| 3,252,295 | 5/1966 | Leister, Jr. | 62/209 |
| 3,425,628 | 4/1969 | Russell | 62/228 |
| 3,950,961 | 4/1976 | Lotz | 62/209 |

*Primary Examiner*—William E. Wayner
*Assistant Examiner*—Harry Tanner
*Attorney, Agent, or Firm*—Thomas B. Hunter

[57] ABSTRACT

A temperature compensated safety control is employed to shut off the compressor at high compression ratios, caused, for example, by reduced air flow over the condenser or other reasons. This is especially useful on both reverse cycle heat pumps and conventional, non-reversible refrigeration and air conditioning systems to protect the compressor. In a preferred embodiment, the temperature compensation is provided by making the control responsive to outdoor ambient air temperatures.

7 Claims, 2 Drawing Figures

Fig. 1.
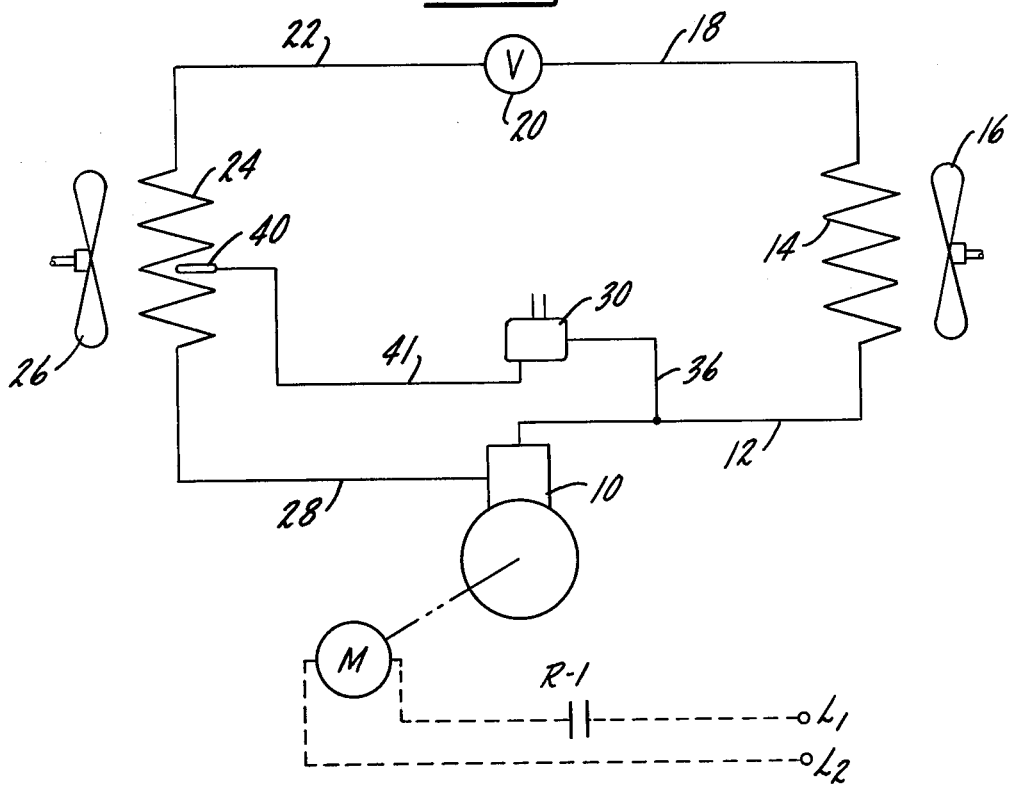
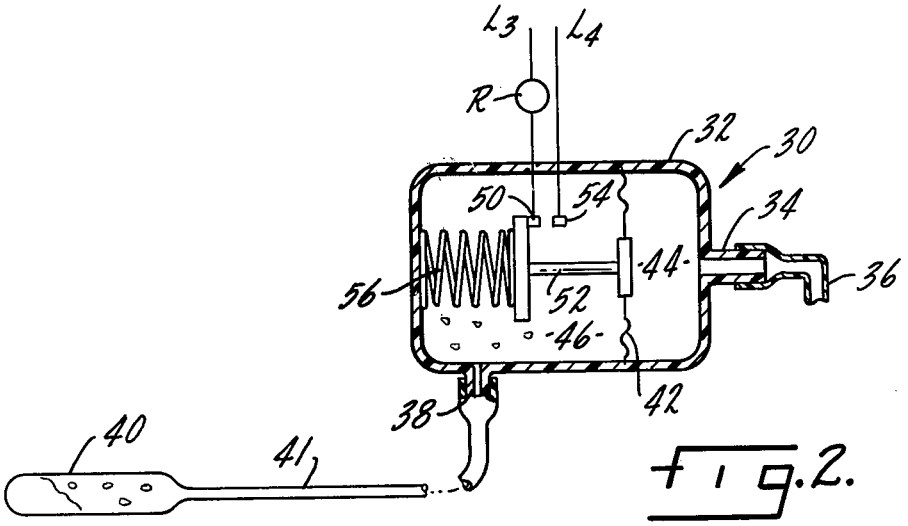
Fig. 2.

TEMPERATURE COMPENSATED CONTROL FOR AIR CONDITIONING SYSTEM OR HEAT PUMP

BACKGROUND OF THE INVENTION

1. Field of the Invention:

Compensated controls for heat pumps and air conditioning units generally classified in Class 62, subclass 215.

2. Description of the Prior Art:

U.S. Pat. 3,113,439 (Eargle) describes a heat pump system having an outdoor temperature compensated thermostat. A thermistor sensing outdoor ambient air temperature is provided in a circuit which will compensate the control in anticipation of heating and cooling requirements. The variable resistance of the thermistor controls the heat output of a small heater affecting the set point of the thermostat.

U.S. Pat. No. 3,252,295 (Leister Jr.) shows an air conditioning system in which both a low temperature start switch and a low pressure cutout switch cooperate with the power supply to the compressor. If suction pressure is too low, then the low pressure cutout switches off power unless the low temperature start switch is making contact. In this case, an alternate path of power to the compressor is provided.

U.S. Pat. No. 2,218,944 (Wolfert) describes a refrigeration system including a very complex control mechanism utilizing a low pressure bellows connected to the suction side of the system and a high pressure bellows connected to the discharge side of the compressor. These two devices cooperate to prevent startup of the compressor in the event the pressure differential is above some predetermined maximum.

U.S. Pat. No. 3,425,628 (Russell) also describes a system using pressure control lines from the low pressure side of a system to maintain the pressure differential within a predetermined setting. Although similar to Wolfert, described above, this patent is slightly more simplified, but still requires an extraordinary number of levers and actuators to accomplish its function.

SUMMARY OF THE INVENTION

One of the most frequent problems encountered in the operation of heat pump systems (and, to a lesser extent, conventional, non-reversible air conditioning systems) is a dirty filter condition which restricts the flow of air circulated over the indoor coil. During heating operations of a heat pump, when the indoor coil is functioning as the condenser, a restricted air flow will greatly increase the condensing temperature and pressure. This condition may cause the compressor to fail due to high compression ratios, the most common failures being broken wrist pins, connecting rods and bearings.

In virtually all heat pump systems, there is a builtin, high pressure cutout. On Refrigerant-22 systems, this is usually set to interrupt power to the compressor at about 400 psia discharge pressure. At an evaporator temperature of 0° F., a compression ratio of 10.3 would be required before the conventional high pressure cutout would trip. This is well above the 8.5 compression ratio which is considered safe. At more extreme conditions, for example at −20° F. evaporator temperature, the compression ratio would be as high as 16.1 before the high pressure shuts down the compressor.

Even with the normally safe high pressures obtained with satisfactory air flow across the indoor coil, the suction pressure can become abnormally low, due, for example, to a badly frosted outdoor coil, a failure of the outdoor fan and/or fan motor or loss of refrigerant in the system. When this occurs, the compression ratio can become excessive and bring about premature failure of the compressor.

In the present invention, I have provided a compensated high pressure cutout which will stop compressor at relatively low discharge pressures with a coincident low outdoor ambient condition. In other words, for normal operation, the set point of the high pressure cutout must be made sufficiently high to allow for operation when the suction pressure is relatively high in order to avoid the nuisance of power interruption to the compressor when it is not reasonably possible that the compressor would be harmed by the condition.

The present invention proposes a very simple device in which a diaphragm cooperates with a switch, typically operating a relay contact for the compressor. The diaphragm is subjected, on one side, to high pressure from the discharge gas line between the compressor and the condenser. The other side of the diaphragm is subject to a pressure exerted by a fluid which is a function of the outdoor ambient air temperature or outdoor coil temperature. This diaphragm cooperates in such a way that the switch that the control will shut off the compressor when a low outdoor ambient or low evaporator temperature exists, even though the condenser pressure is well below 400 psia, the pressure where normally the high pressure cutout would trip.

DESCRIPTION OF THE DRAWINGS

FIG. 1 is a schematic diagram of a vapor compression cycle refrigeration system; and FIG. 2 is a cross-section view, partly schematic in nature, illustrating the pressure compensated control apparatus in more detail.

DESCRIPTION OF THE PREFERRED EMBODIMENT

Referring to the drawings, FIG. 1 shows, in schematic form a basic refrigeration system which for purposes of the description may be considered as a heat pump system (operating in the heating mode), or a conventional non-reversible refrigeration or air conditioning system. If considered as representing a heat pump system, it should be noted that the reversing valve and various check valves, expansion devices and accumulators, which are used in such systems, are not shown for simplicity.

As best shown in FIG. 1, a compressor 10 is connected by means of hot gas line 12 to condenser 14, which in heat pump systems (in the heating mode) is the indoor coil. A fan 16 circulates indoor air over the coil and the warm air is circulated throughout the heated space. Condensed refrigerant is transferred from condenser 14 through line 18 to an expansion device 20 which may be a capillary or a thermostatic expansion valve. The low pressure liquid refrigerant flows through line 22 to the evaporator 24 which in heat pump systems (operating in the heating mode) is the outdoor coil. A fan 26 circulates ambient air over coil 24 and the air gives up heat to the refrigerant causing it to vaporize. The low pressure vapor flows through line 28 to the suction side of the compressor.

The compressor 10 is driven by motor M which is supplied with electrical power though lines $L_1$, $L_2$ one of said lines containing a relay contact R-1. When R-1 is closed, the power is supplied to the motor to drive the compressor 10.

The temperature compensated pressure cutout 30, the details of which are shown in FIG. 2, comprises a casing 32 which is connected at 34 to a high pressure line 36 leading to hot gas line 12. Casing 32 also has another connection 38 which connects with refrigerant filled capillary line 41 and bulb 40. The bulb is of the limited fill (or cross ambient charge) type so that above a predetermined temperature only the vapor phase exists. This limits the effect of any rise in temperature over and above the set, predetermined temperature. Inside the casing 32 is a diaphragm 42 which forms a closed chamber 44 subject to the pressure variations in the high pressure line 36 and a closed chamber 46 responsive to the capillary bulb. The bulb may be placed at one of several locations: (1) in the air stream adjacent the evaporator coil; or (2) fixed directly to the coil; or (3) another location where it fairly represents evaporator ambient air temperature or evaporator coil temperature.

The control device 30 includes a first, moveable contact 50 which is secured to diaphragm 42 by means of a rod 52 and a second, stationary contact 54. Contacts 50 and 54, respectively, are in series with a relay R adapted to be connected with a source of low voltage power through conductors $L_3$ and $L_4$.

Within chamber 46 is a spring 56 or other resilient menas which biases the diaphragm 42 so that the contacts will tend to close.

Operation

Assume that the tension of the compression pre-load on spring 56 is set in such a way that contact 50 and 54 will be closed when the temperature sensed by bulb 40, as applied through line 41 indicates an outdoor coil or ambient air temperature corresponding to a refrigerant pressure of about 90 psia and the pressure in chamber 44, which is subject to discharge pressure, is 400 psia. This would give a pressure ratio of 4.4 which is satisfactory for safe operation of the compressor. If for some reason the temperature of the evaporator air should fall to a temperature which would produce an outdoor coil pressure of about 45 psia while the discharge pressure remained at 400 psia, the reduced temperature affecting the left hand side of diaphragm 42 would tend to open the contacts 50 and 54 and discontinue operation because of the high compression ratio of 8.9. If the outdoor temperature remained constant with an evaporator pressure of 90 psia, and discharge pressure rose to 415 psia then pressure acting on the right hand face of diaphragm 42 would move contact 50 to the left and open the circuit. When the evaporator coil or air temperature is above the value where the evaporator pressure will be approximately 90 psia, the cross ambient charge in the bulb will become completely evaporated, so that any further rise in temperature will not oppose the high pressure on the opposite side of the diaphragm. Consequently, the contacts 50 and 54 will open anytime the high pressure gets above approximately 400 psia, regardless of the evaporator air temperature.

While this invention has been described in connection with a certain specific embodiment thereof, it is to be understood that this is by way of illustration and not by way of limitation; and the scope of the appended claims should be construed as broadly as the prior art will permit.

What is claimed is:

1. A vapor compression cycle refrigeration system comprising: a compressor having a discharge outlet and a suction inlet, a condenser, an expansion device, and an evaporator, all connected in closed circuit relation such that the high pressure side of the system is between the compressor discharge outlet and the expansion device and the low pressure side of the system is between said expansion device and said compression suction inlet; an electric motor driving said compressor; and cutout means for discontinuing the power supplied to said electric motor including means responsive to: (1) pressure on the high pressure side of said system; and (2) evaporator air temperature, and switch means operated by said temperature and pressure responsive means such that an increase in high side pressure will tend to open said switch means and an increase in evaporator air temperature will tend to close said switch means, said temperature and pressure responsive means including a flexible diaphragm, the movement of which is a function of the pressure existing on the high pressure side of said system and the evaporator air temperature.

2. A system as defined in claim 1 including a filled capillary bulb and tube responsive to evaporator air temperature, said capillary bulb and tube cooperating with said flexible diaphragm such that a decrease in evaporator air temperature tends to move said diaphragm in a direction toward opening said switch means.

3. A system as defined in claim 2 wherein said bulb has a cross-ambient charge.

4. A vapor compression cycle refrigeration system comprising: a compressor having a discharge outlet and a suction inlet, a condenser, an expansion device, and an evaporator, all connected in closed circuit relation such that the high pressure side of the system is between the compressor discharge outlet and the expansion device and the low pressure side of the system is between said expansion device and said compression suction inlet; an electric motor driving said compressor; and cutout means for discontinuing the power supplied to said electric motor including means responsive to: (1) pressure on the high pressure side of said system; and (2) evaporator coil temperature, and switch means operated by said temperature and pressure responsive means such that an increase in high side pressure will tend to open said switch means and an increase in evaporator coil temperature will tend to close said switch means, said temperature and pressure responsive including a flexible diaphragm, the movement of which is a function of the pressure existing on the high pressure side of said system and the evaporator coil temperature.

5. A system as defined in claim 4 wherein said means responsive to evaporator coil temperature includes a sensor mounted on the evaporator surface.

6. A system as defined in claim 4 including a filled capillary bulb and tube responsive to evaporator coil temperature, said capillary bulb and tube cooperating with said flexible diaphragm such that a decrease in evaporator coil temperature tends to move said diaphragm in a direction toward opening said switch means.

7. A system as defined in claim 6 wherein said bulb has a cross-ambient charge.

* * * * *

UNITED STATES PATENT OFFICE

CERTIFICATE OF CORRECTION

PATENT NO. : 4,221,116

DATED : September 9, 1980

INVENTOR(S) : JAMES RANCK HARNISH

It is certified that error appears in the above-identified patent and that said Letters Patent are hereby corrected as shown below:

Column 4, line 51, after "responsive" insert -- means --.

Signed and Sealed this

Ninth Day of December 1980

[SEAL]

*Attest:*

SIDNEY A. DIAMOND

*Attesting Officer*

*Commissioner of Patents and Trademarks*